United States Patent [19]

Tonkiss

[11] Patent Number: 5,007,465

[45] Date of Patent: Apr. 16, 1991

[54] HAND OPERATED BAND BENDING TOOL

[75] Inventor: David W. Tonkiss, Glendale, Calif.

[73] Assignee: Joslyn Corporation, Chicago, Ill.

[21] Appl. No.: 446,938

[22] Filed: Dec. 6, 1989

[51] Int. Cl.[5] ..... B21F 15/06

[52] U.S. Cl. ..... 140/150; 140/93.4

[58] Field of Search ..... 140/93.4, 150, 152, 140/153, 154; 100/30, 33 R

[56] References Cited

U.S. PATENT DOCUMENTS

| | | | |
|---|---|---|---|
| 2,643,687 | 6/1953 | Schlage et al. | 140/152 |
| 2,928,434 | 3/1960 | McAneny | 140/93.4 |
| 4,227,299 | 10/1980 | Kuehling | 72/465 |
| 4,696,327 | 9/1987 | Wolcott | 140/150 |
| 4,726,403 | 2/1988 | Young et al. | 140/123.6 |

*Primary Examiner*—Lowell A. Larson

*Attorney, Agent, or Firm*—Mason, Kolehmainen, Rathburn & Wyss

[57] ABSTRACT

A band finishing tool having a scissor-type mechanism utilizes a sliding pawl to hold one side of the buckle. The other side of the buckle is held along the edges of by buckle holding members to allow the free end of the tab to be folded over and engage the outside band diameter. The sliding pawl is mechanically coupled to the scissor-type mechanism. A rigid rollover member is mechanically coupled to the sliding pawl by way of a coupling spring. Initial squeezing of the scissor-type mechanism causes the sliding pawl to engage the buckle. Further squeezing of the scissor-type mechanism causes the rollover member to move laterally with respect to the pawl. This movement causes the tab to be folded over the buckle. The tool also includes a slot for prebending the leading edge of the tab at approximately a 45° angle with respect to the band axis.

19 Claims, 6 Drawing Sheets

FIG. 1
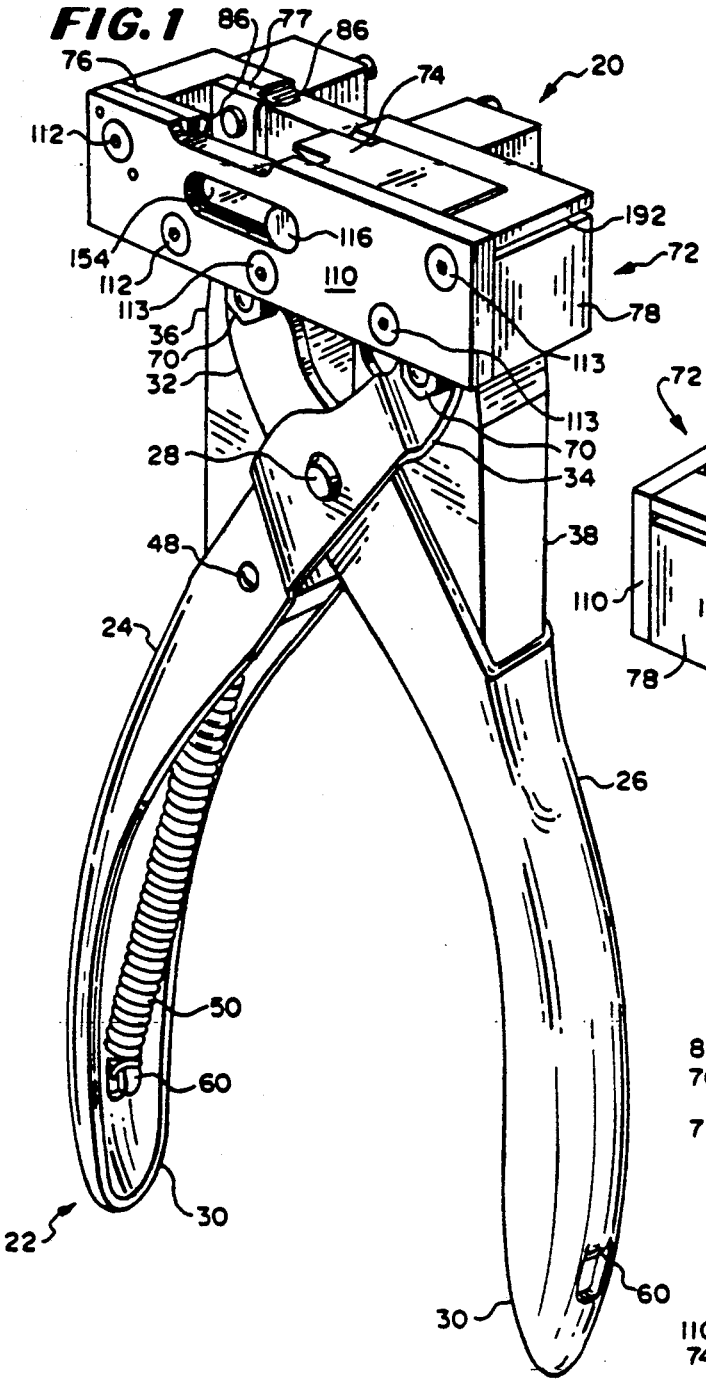
FIG. 2
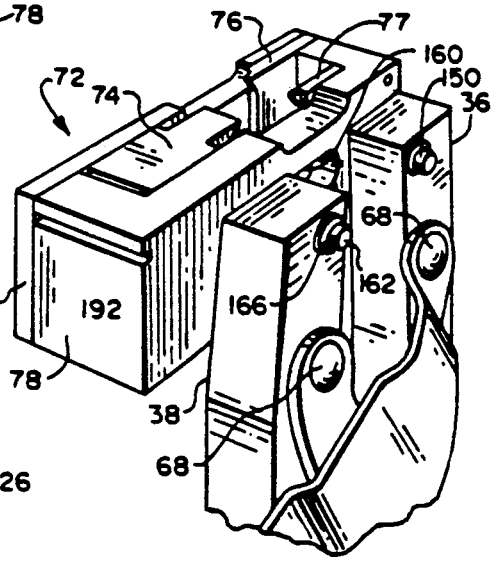
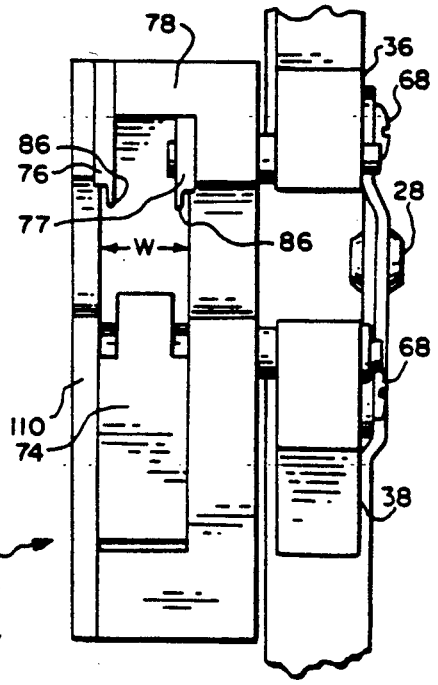
FIG. 3

FIG. 10
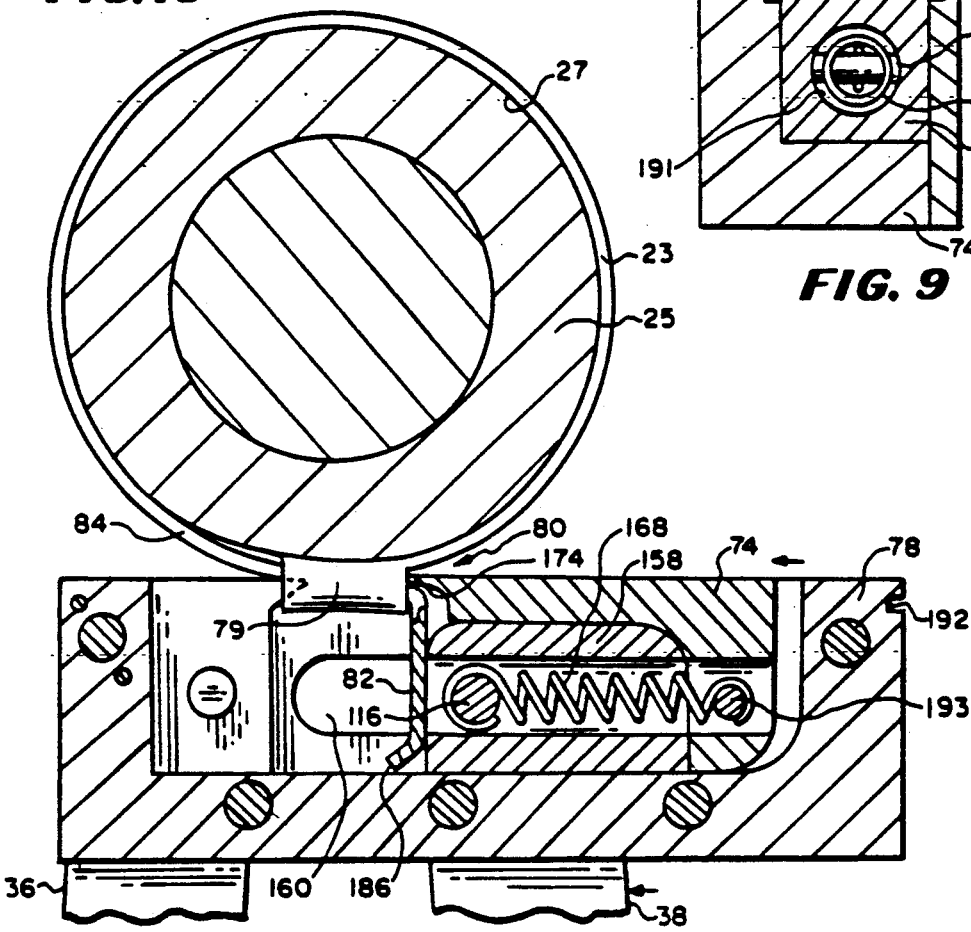
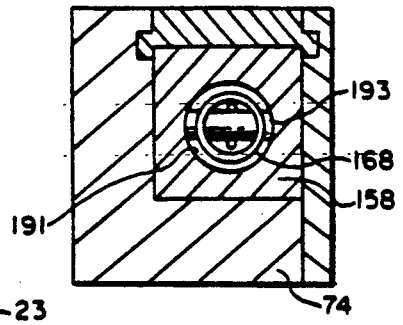
FIG. 9
FIG. 11
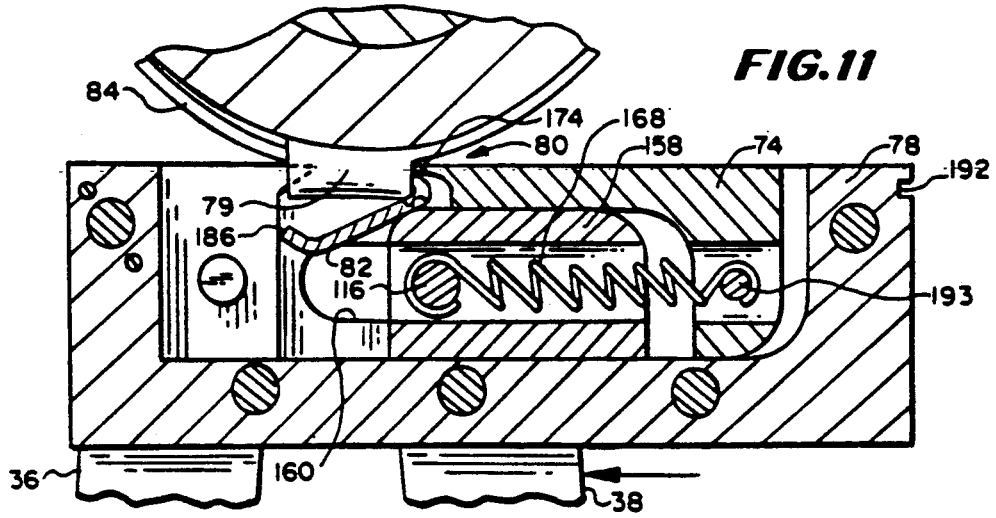

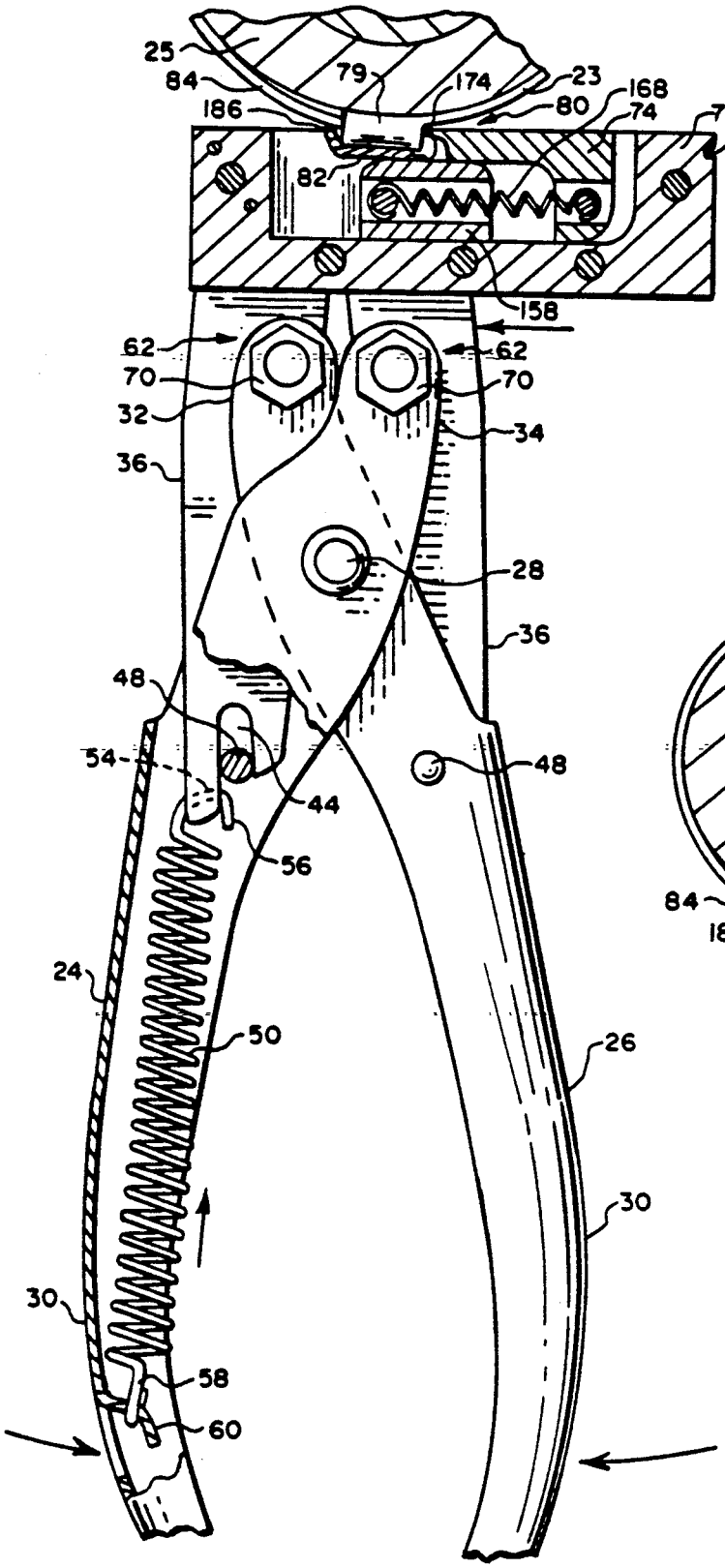
FIG. 12
FIG. 13
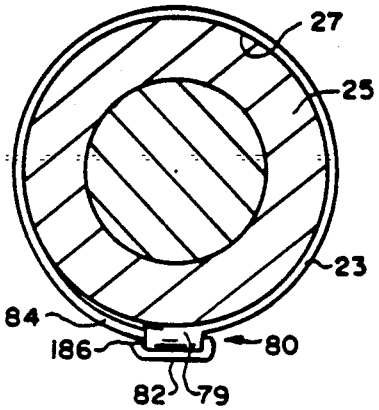

HAND OPERATED BAND BENDING TOOL

BACKGROUND OF THE INVENTION

1. Field of the Invention

The present invention relates to a band finishing tool and more particularly to a tool for completing a banding operation by folding the free end of the band over the buckle.

2. Description of the Prior Art

Metallic bands are often used to terminate an electromagnetic shield, such as a woven copper braid, to a termination sleeve integral to an electrical connector accessory known as a backshell. The woven copper braid is placed over the termination sleeve. A metallic band, such as disclosed in U.S. Pat. No. 4,751,769, assigned to the same assignee as the present invention and incorporated by reference, is then slipped over the woven copper braid. A banding tool which may either be manually operated, such as disclosed in U.S. patent application Ser. No. 07/370,597, filed on June 23, 1989, or a power operated banding tool, such as disclosed in U.S. patent application Ser. No. 07/277,325, filed on Nov. 29, 1988, both assigned to the same assignee as the present invention, may be used to tighten the band about the termination sleeve. The band is then bent at approximately a 90° angle with respect to the buckle to secure the tension in the band. Subsequently, the metallic band is severed a predetermined distance from the buckle defining a free end or tab. After the band is severed, the termination may be removed from the banding tool with the tab extending at approximately a 90° angle with respect to the buckle. In order to finish the termination, it is necessary to fold the extending tab over the buckle in such a way to prevent the sharp edges of the extending tab from causing damage to adjacent electrical cable or connector assemblies.

Various tools are known in the art for finishing the banding operation. One such tool is disclosed in U.S. Pat. No. 4,696,327. This tool includes a scissor-type mechanism having opposed blade feet, approximately the width of the metallic band, adapted to slip under the buckle to hold the termination in place during the finishing operation. Initially, upon squeezing the scissor mechanism, the opposing blade feet are displaced toward each other until they engage the buckle.

The tool also includes a reciprocally mounted resilient roller assembly which serves to fold the tab over the buckle. The resilient roller assembly is attached to the scissor-type mechanism such that squeezing of the scissor mechanism causes the lateral movement of the roller assembly. As the roller assembly is moved laterally, the elastomeric material engages the extending tab to fold the tab over the buckle.

Since the opposing blade feet extend the width of the metallic band, the blade foot at the tab end of the buckle prevents the extending tab from being bent flush with the outside diameter of the band. This causes an undesirable gap between the free end of the tab and the outside diameter.

Another disadvantage of the tool disclosed in the aforementioned U.S. patent related to the elastomeric material used to cover the roller. More specifically, once the tab is folded over the buckle, the elastomeric material holds the tool in its articulated position. This then requires considerable force to be applied to the scissor mechanism to spread it apart to release the termination from the tool.

SUMMARY OF THE INVENTION

Accordingly, it is an object of the present invention to provide a band finishing tool which solves the problem associated with the prior art.

It is another object of the present invention to provide a band finishing tool which allows the extending tab to be folded into engagement with the outside band diameter.

It is yet another object of the present invention to provide a band finishing tool which allows the termination to be rather easily released from the tool when the band finishing operation is complete.

Briefly, the present invention relates to a band finishing tool having a scissor-type mechanism defining a pair of handles and corresponding operating levers. A sliding pawl is reciprocally mounted for lateral movement to one of the operating levers and is used to hold one side of the buckle. The other side of the buckle, adjacent the free end of the tab, is held along the edges of the buckle to allow the free end of the tab to be folded over to engage the outside band diameter. Upon initial squeezing of the handles, the sliding pawl moves laterally to engage the buckle. A rigid rollover member is also coupled to the scissor-type mechanism such that further squeezing of the handles causes the rollover member to move laterally with respect to the pawl to cause the tab to be folded over the buckle. The tool also includes a slot for prebending the free end of the band at approximately a 45° angle with respect to the band axis to allow the free end to engage the outside band

DESCRIPTION OF THE DRAWING

These and other objects and advantages of the present invention will become readily apparent upon consideration of the following detailed description of the attached drawing, wherein:

FIG. 1 is a perspective view of the band finishing tool in accordance with the present invention;

FIG. 2 is a partial perspective view of the tool in FIG. 1 illustrating the top portion of the tool;

FIG. 3 is a partial top view of the tool illustrated in FIG. 1;

FIG. 9 is a sectional view taken along line 9—9 of FIG. 8;

FIG. 10 is similar to FIG. 8 and illustrates the position of the components within the tool in an intermediate position showing the pawl gripping the buckle;

FIG. 11 is a similar to FIG. 10 and illustrates the position of the components within the tool in a further stage of operation wherein the tab is initially bent;

FIG. 12 is similar to FIG. 11 and illustrates the position of the components within the tool when the operation is complete but before the handles are released; and FIG. 13 is a top sectional view showing the completed termination.

DETAILED DESCRIPTION

Figure 5:
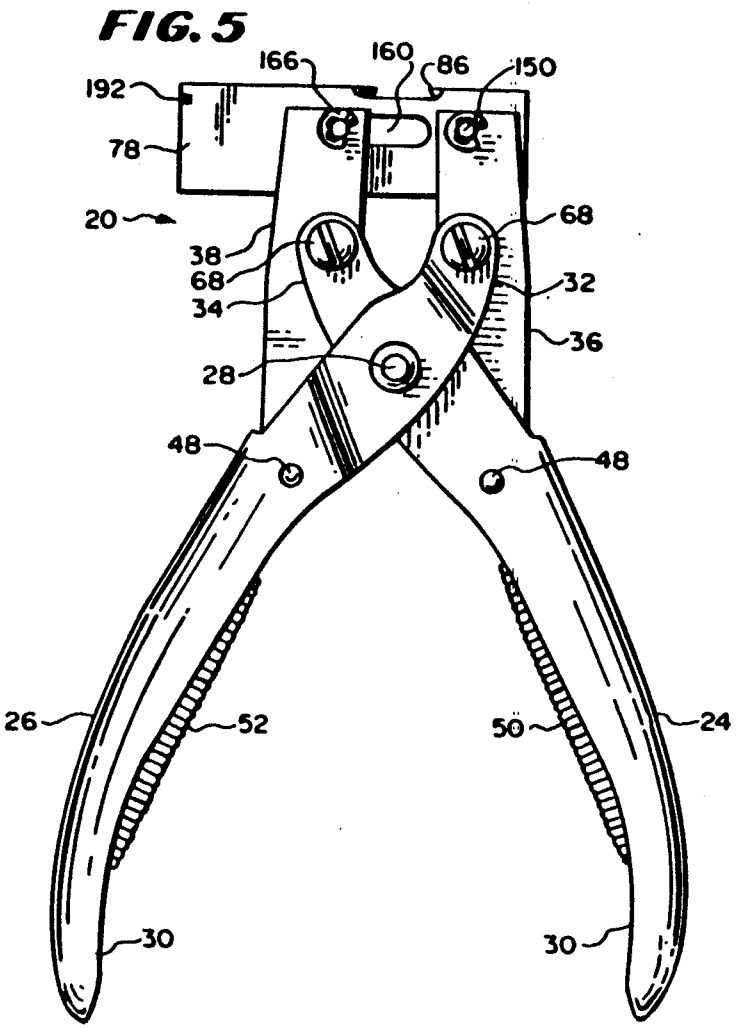
FIG. 5 is similar to FIG. 4 but illustrates of the other side the tool.
Figure 4:
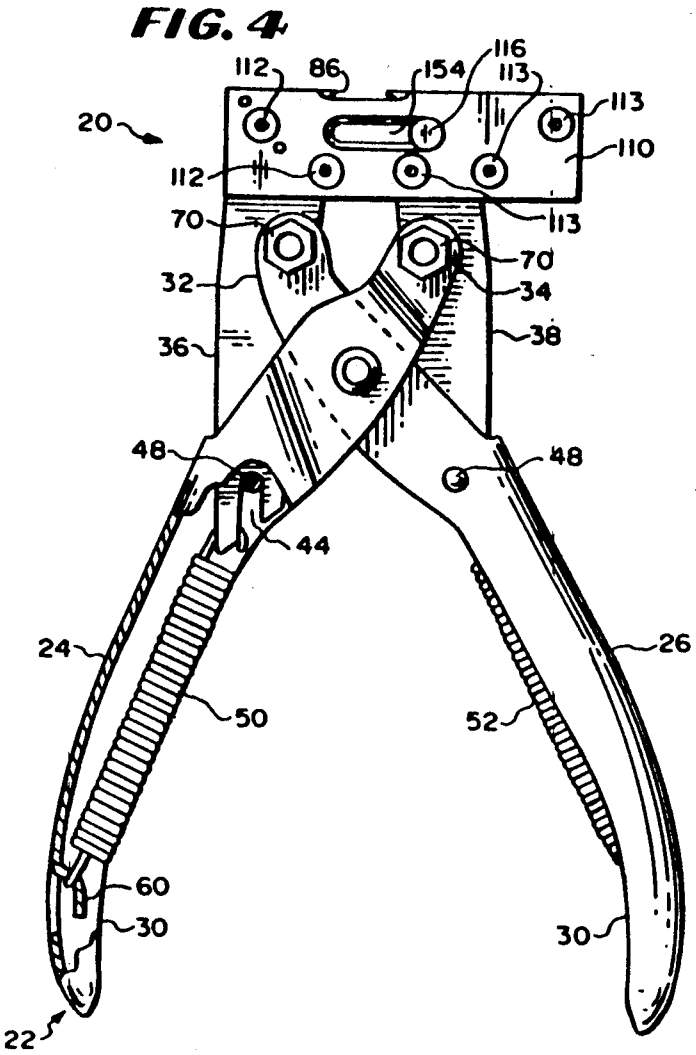
FIG. 4 is an elevational view of one side of the tool illustrated in FIG. 1 in a relaxed position.
Figure 6:
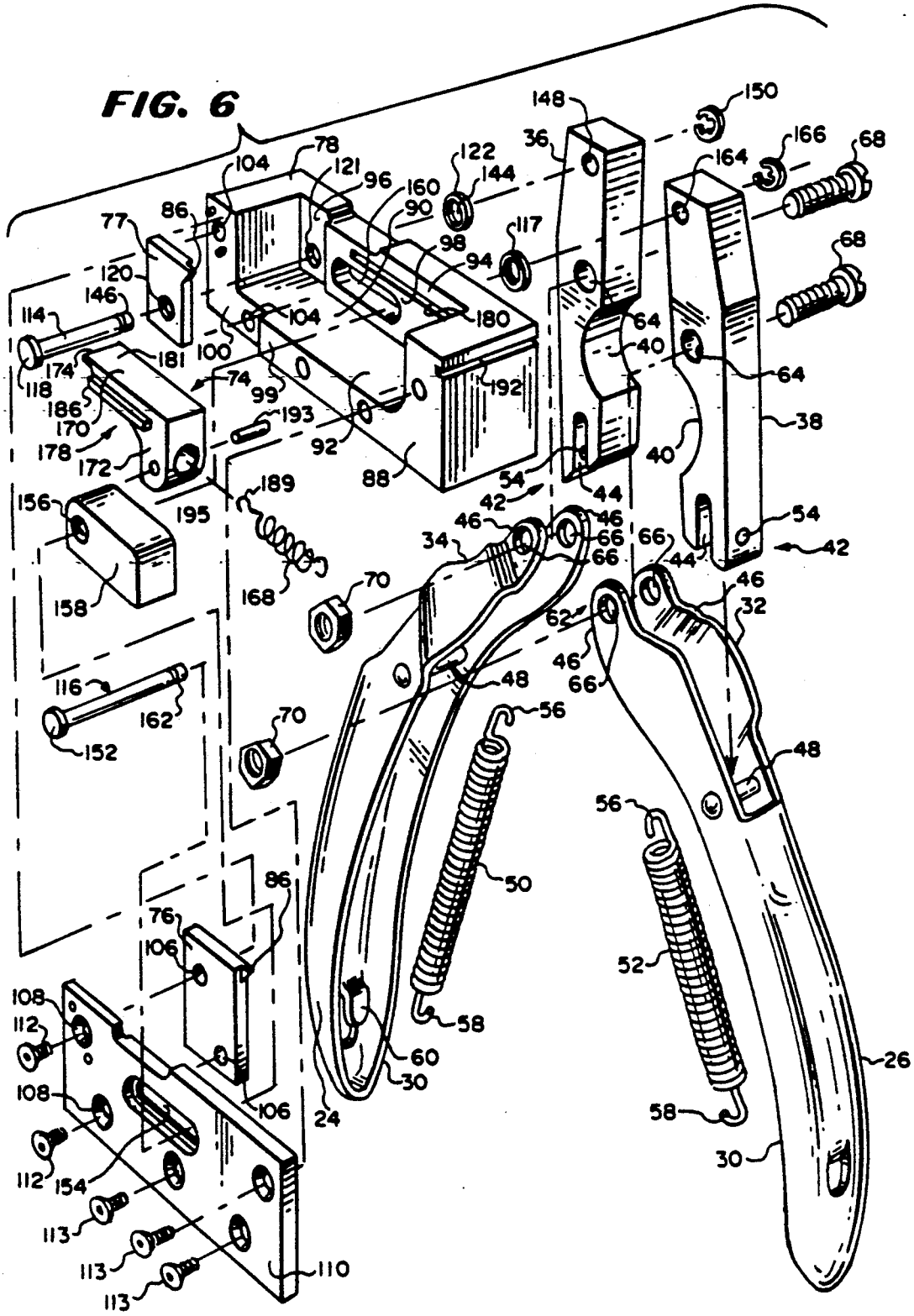
FIG. 6 is an exploded, perspective view of the tool illustrated in FIG. 1.

The band finishing tool in accordance with the present invention is generally identified with the reference numeral 20. The tool 20 is used to secure a band 23 around a woven copper braid 27 to a termination sleeve 25 forming a part of an electrical connector assembly.

The band finishing tool is a manually operated tool which includes a scissor-type assembly 22 formed from two levers 24 and 26 joined together by a pivot pin 28 defining a pair of U-shaped handles 30 and operating levers 32 and 34. A pair of movable jaws 36, 38 is mechanically coupled to the operating levers 32 and 34. The movable jaws 36, 38 move parallel to one another as the handles 30 are squeezed.

Each movable jaw 36, 38 is formed as a generally elongated, rectangular member having an arcuate notch 40 disposed intermediate the ends. The arcuate notch 40 provides clearance for the pivot pin 28 when the jaws 36 and 38 are in engagement. The bottom portions 42 of each of the jaws 36, 38 are provided with an axial slot 44 that is adapted to be received between two parallel spaced apart extending finger portions 46 formed in the operating levers 34 and 36. The axial slot 44 receives a pin 48, transversely disposed in each of the handles 30 between the extending finger portions 46.

The jaws 36 and 38 are attached to the operating handle 30 by way of springs 50 and 52. More specifically, a transverse aperture 54 is provided in the bottom portion 42 of each jaw 36 and 38 to receive one end 56 of the springs 50 and 52. The other ends 58 of the springs 50 and 52 are attached to an inwardly bent tab 60, integrally formed in each of the handles 30.

Each jaw 36 and 38 is also rigidly attached to the ends 62 of the operating levers 32 and 34. More specifically, each jaw 36 and 38 is provided with a transverse aperture 64. The transverse aperture 64 in each jaw 36 and 38 is aligned with a pair of aligned apertures 66 formed in the extending finger portions 46. A threaded fastener 68 is inserted through the apertures 64 and 66. A nut 70 is tightened about the extending portion of the fasteners 68 to secure the jaws 36 and 38 to the operating levers 32 and 34.

This arrangement provides a slidable attachment of the jaws 36 and 38 with respect to the operating levers 32 and 34. In operation, as the handles 30 are squeezed, the jaw members 36 and 38 move parallel toward each other. This action opposes the spring force of the springs 50 and 52. Once the handles 30 are released, the tool 20 returns to its original or relaxed position as shown in FIGS. 1, 2, 3, 4, 5, 7 and 8.

An important aspect of the invention relates to the band bending mechanism 72. The band bending mechanism 72 includes a single reciprocally mounted pawl 74 which cooperates with a pair of stationary buckle holding members 76 and 77. The pawl 74 and the buckle holding members 76 and 77 hold the buckle 79 during the bending operation.

The buckle holding members 76 and 77 are formed as plate-like members having a triangular-shaped protuberance 86, disposed adjacent one corner of the plate. These protuberances 86 engage the buckle 79 opposite the tab side 80. This arrangement allows the tab 82 to be bent to engage the outside band diameter 84.

A chassis 78 carries the pawl 74 and the buckle holding members 76 and 77. The chassis 78 is formed as a rectangular-shaped member 88 having a generally rectangular cutout 90 defining an open side 92 and an open top 94. The chassis 78 is formed with a first inset 96 on the interior of a wall 98. The inset 96 is adapted to receive the buckle holding member 77. A front portion 99 of the chassis 78 is provided with a second inset 100 for receiving the buckle holding member 76. This arrangement provides spacing between the oppositely disposed buckle holding members 76 and 77, slightly larger than the width W (FIG. 3) of the reciprocally mounted pawl 74. This allows the buckle 79 to be held while allowing the extending tab 82 to be bent over and into engagement with the outside band diameter 84.

The buckle holding members 76 and 77 are rigidly mounted to the chassis 78. A pair of tapped holes 104 is provided in the inset 100, adapted to be aligned with a pair of apertures 106 provided on the buckle holding member 76. The tapped holes 104 and the apertures 106 are aligned with a pair of apertures 108 provided in a cover plate 110 used to close the open side 92. Threaded fasteners 112 are inserted into the pairs of apertures 106 and 108 and screwed into the tapped holes 104 to secure the cover plate 110 and the buckle holding member 76 to the chassis 78. The cover plate 110 is further attached to the chassis 78 with a plurality of other fasteners 113.

The other buckle holding member 77 and band bending mechanism 72 are rigidly secured to the chassis 78. More specifically, the band bending mechanism 72 is secured to the jaws 36 and 38 with two pins 114 and 116. The pin 114 is formed with a head portion 118 and is received in an aperture 120 in the buckle holding member 77 and into an aligned aperture 121 formed in the wall 98 of the chassis 78. A spacer 122 with a central aperture 144 is disposed between the exterior of the wall 98 and the jaw member 36. The pin 114 is also received in a transverse aperture 148 in the jaw member 36. An "E" type clip 150 is inserted over an extending shank portion 146 of the pin 114 to secure the buckle holding member 77 and the chassis 78 to the jaw member 36.

The band bending mechanism 72 is secured to the other jaw member 38 by way of the pin 116 and spacer 117. The pin 116 is formed with a head portion 152 and is inserted into a slot 154 formed in the cover plate 110. The slot 154 is formed to capture the head portion 152 of the pin 116 in one direction. The pin 116 is inserted into a transverse aperture 156 in a rollover member 158 and into an elongated slot 160 formed in the wall 98 of the chassis 78. An extending shank portion 162 of the pin 116 is also received in a transverse aperture 164 in the other jaw member 38 and secured thereto with an "E" clip 166.

The pawl 74 is mounted for reciprocal movement along an axis generally parallel to the longitudinal axis of the chassis 78. More specifically the pawl 74 is formed as a generally L-shaped member defining a relatively long leg portion 170 and a relatively shorter leg portion 172. A free end 174 of the long leg portion 170 is beveled to facilitate engagement of the buckle 79. The long leg portion 170 is formed with oppositely disposed runners 176. These runners 176 are formed as generally elongated rectangular members disposed on opposite sides 178 of the long leg portion 170 and offset downwardly from the top plane 181 of the pawl 74. These runners 176 are received in an elongated rectangular slot 180 formed in the interior side of the wall 98 of the chassis 78 and an oppositely disposed slot (not shown) formed in the interior of the cover plate 110. These slots act as guides to allow the pawl 74 to be movable along an axis generally parallel to the longitudinal axis of the chassis 78.

The length of the runners 176 is relatively shorter than the length of the slots. In the initial position, the runners 176 engage the rear portion 184 of the slots. As the handles 30 are squeezed, the runners 176 move toward the buckle holding members 86. During this stage of operation, the pawl 74 and the rollover member 158 move together. When the leading blade edge 174 of the pawl 74 engages the band end/buckle area as shown in FIG. 10, further movement of the pawl 74 is precluded.

The rollover member 58 is mounted within the chassis 78 for reciprocal movement relative to the pawl 74 and is mechanically coupled to the pawl 74 by way of a coupling spring 168. More specifically, one end 189 of the coupling spring 168 is received in a transverse bore 191 in the short leg portion 172 of the pawl 74. A pin 193 is inserted into another transverse bore 195 whose axis is displaced 90° from the bore 191. The other end of the spring 168 is attached to the pin 116. Once the blade edge 174 engages the band end/buckle area, firmly gripping the buckle, further squeezing of handles 30 causes the rollover member 158 to move relative to the pawl 74 to bend the extending tab 82 of the band over the buckle 79 against the spring force of the coupling spring 168. Since the triangular protuberances 86 of the buckle holding members 76 and 77 are disposed adjacent the outside band diameter 84, movement of the rollover member 158 in a direction toward the buckle holding members 76 and 77 allows the extending tab 82 to be bent such that its end 186 engages the outside band diameter 84.

Initially, upon release of the handles 30 the rollover member 158 retracts with respect to the pawl 74 under the influence of the coupling spring 168. Subsequently, the biasing springs 50 and 52 cause the handles 30 to return to their normal relaxed position. Since the rollover member 158 is formed from a rigid member as opposed to a resilient member, the tool 20 returns to its normal or relaxed position upon release of the handles 30 with little or no additional force.

Figure 7:
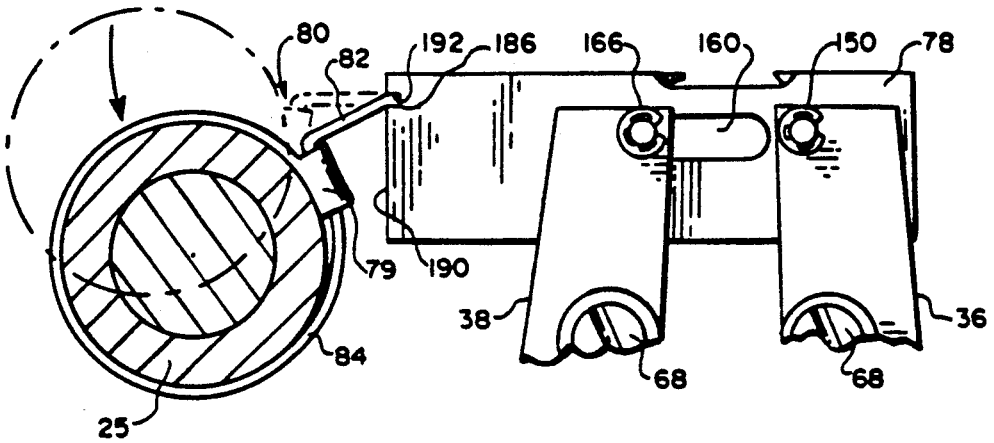
FIG. 7 is a partial side view of a portion of the tool of FIG. 1 illustrating the prebending operation.

Another important aspect of the tool, relates to means for prebending the leading edge 186 of the tab 82 at approximately a 45° angle with respect to the longitudinal axis of the band. More specifically, an outside surface of one wall 190 of the chassis 78 is provided with a transverse slot 192. The leading edge 186 of the tab 82 is inserted in the transverse slot 192. As best shown in FIG. 7, movement of the termination with respect to the tool 20 thus causes the leading edge 186 to be bent downwardly at approximately a 45° angle. Thus, when the tab 82 is bent by the rollover member 58, the leading edge 186 will engage the outside band diameter 84 when the termination is complete, as shown in FIG. 13.

Figure 8:
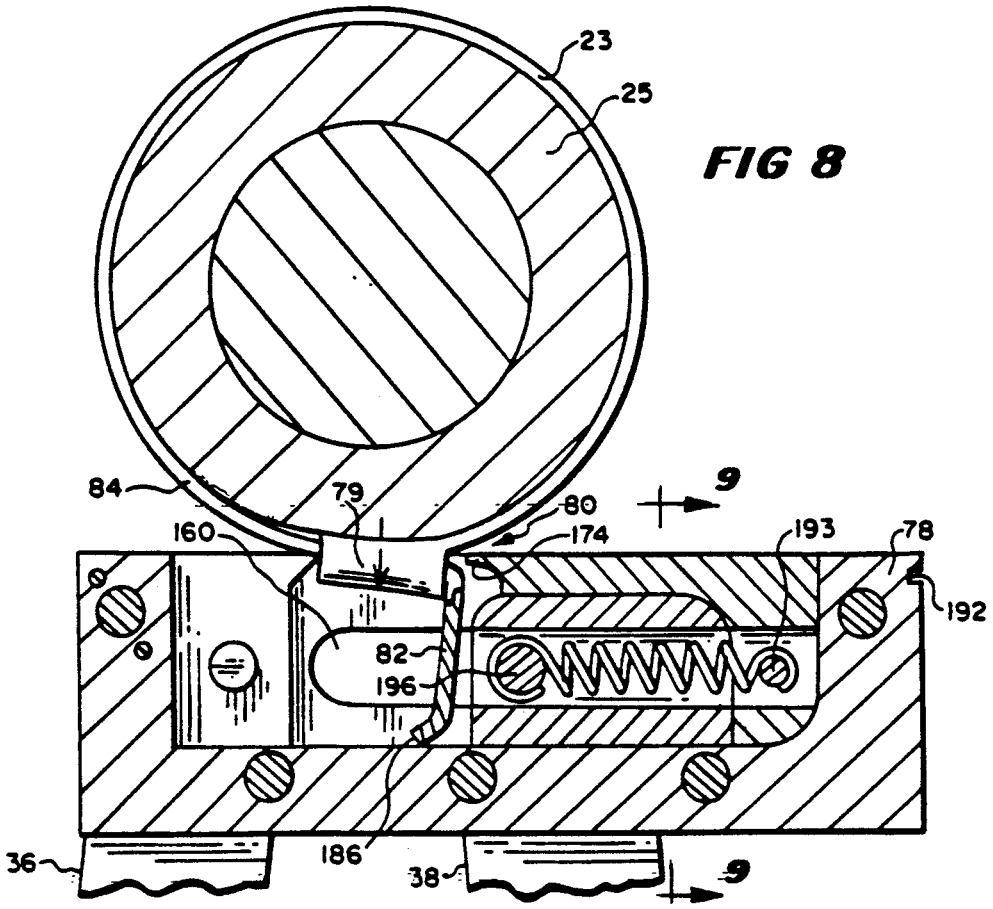
FIG. 8 is a partial side sectional view of the top portion of the tool in a relaxed position, illustrating a termination inserted into the tool.

In operation, the leading edge 186 of the tab 82 is prebent as described above. Next, the buckle 79 and extending tab 82 are placed in an opening 194 formed on the top side 94 of the chassis 78 such that the tab side 80 of the buckle 79 is engaged by the blade edge 174. The opposite side of the buckle 79 is engaged by the buckle holding members 76 and 77 as shown in FIG. 8. The handles 30 are then squeezed until the pawl 74 engages the buckle 79 as shown in FIG. 10. Further squeezing of the handles 30 causes the rollover member 158 to bend the tab 82 over the buckle 79 as shown in FIG. 11. The end of the stroke occurs when the jaw members 36 and 38 are in engagement and the prebent portion 186 of the tab 82 is in engagement with the outside band diameter 84 as shown in FIG. 12. Upon release of the handles 30, the rollover member 158 moves to the right (FIG. 12) under the influence of the coupling spring 168. Further release of the handles 30 causes the handles 30 to spread apart to the normal or relaxed position under the influence of the biasing springs 50 and 52.

One advantage of the tool in accordance with the present invention is that the rigid rollover member 158 allows the tool 20 to return to its open position either under the influence of the biasing springs 50 and 52 and the coupling spring 168 with very little force or no additional force. Also, the use of the buckle holding members 76 and 77 allows the prebent leading edge 186 to be bent to engage the outside band diameter 84.

Obviously many modifications and variations of the present invention are possible in light of the above teachings. Thus it is understood that within the scope of the appended claims, the invention may be practiced otherwise than as specifically designated above.

What is claimed and desired to be covered by U.S. Letters Patent is set forth as follows:

I claim:

1. A band finishing tool for bending a free end of a band extending from one side of a buckle over the buckle, said buckle formed with a slot defining internal edges, comprising:

means for holding said internal edges of the buckle and allowing said free end to be bent over the buckle and contact the band on the other side of the buckle; and means for bending said free end over said buckle to be in contact with said band on said other side of the buckle.

2. A band finishing tool as recited in claim 1, wherein said bending means includes a rigid rollover member.

3. A band finishing tool as recited in claim 2, wherein said rollover member is movably mounted with respect to said holding means.

4. A band finishing tool as recited in claim 1, wherein said holding means includes only one movably mounted member adapted to engage an end of said buckle.

5. A band finishing tool as recited in claim 4, wherein said holding means includes means for holding one end of said buckle on opposing edges adjacent the band.

6. A band finishing tool for bending a free end of a band extending from one side of a buckle over the buckle, said buckle formed with a slot defining internal edges, comprising:

a pair of levers pivotally connected together intermediate the ends forming a scissor-type mechanism defining a pair of operating levers and a pair of handles for operation between a first position and a second position;

a pair of reciprocally mounted jaws mechanically coupled to said operating levers;

means for bending the free end over the buckle, carried by said pair of jaws; and means for holding said internal edges of the buckle and allowing said free end to be bent over the buckle so as to be in contact with the band on the other side of the buckle opposite the free.

7. A band finishing tool as recited in claim 6, further including means for prebending a leading edge of said free end.

8. A band finishing tool as recited in claim 7, wherein said prebending means is adapted to bend the leading edge of said free end at an angle approximately 45° relative to a longitudinal axis of the band.

9. A band finishing tool as recited in claim 8, wherein said prebending means includes a slot formed in a rigid member.

10. A band finishing tool as recited in claim 6, further including biasing means for biasing said tool to said first position.

11. A band finishing tool as recited in claim 6, wherein said bending means includes a rigid rollover member.

12. A band finishing tool as recited in claim 11, further including means for coupling said rollover member to said holding means.

13. A band finishing tool as recited in claim 12, wherein said coupling means includes a spring attached to said rollover member and said holding means.

14. A band finishing tool as recited in claim 6, wherein said holding means includes a movably mounted pawl.

15. A band finishing tool as recited in claim 14, further including coupling means for coupling said pawl and said bending means such that they move together for a predetermined distance.

16. A band finishing tool as recited in claim 15, further including means for allowing said bending means to move past said predetermined distance.

17. A band finishing tool as recited in claim 6, wherein said holding means further includes a rigid member for holding one end of the buckle at a position adjacent the free end.

18. A band finishing tool as recited in claim 17, wherein said rigid member is formed from a plate having a protuberance extending from one corner.

19. A band finishing tooling for bending an extending tab over a buckle comprising:

a pair of levers pivotally connected together intermediate the ends forming a scissor-type mechanism defining a pair of operating levers and a pair of handles for operation between a first position and a second position;

a pair of reciprocally mounted jaws mechanically coupled to said operating levers;

means for bending the extending tab over the buckle, carried by said pair of jaws;

means for holding said buckle including second means for engaging one end of the buckle, said second means movably mounted and third means for holding the other end of the buckle, said third means mounted stationary relative to said second means; and biasing means for biasing said tool to said first position; wherein said biasing means includes one or more springs connected between said jaws and said handles.

* * * * *

UNITED STATES PATENT AND TRADEMARK OFFICE

CERTIFICATE OF CORRECTION

PATENT NO. : 5,007,465

DATED : April 16, 1991

INVENTOR(S) : David W. Tonkiss

It is certified that error appears in the above-identified patent and that said Letters Patent is hereby corrected as shown below:

Column 2, line 34 "outside band" should be --outside band diameter.--

Column 2, line 50 "side the" should be --side of the--

Signed and Sealed this

Eleventh Day of August, 1992

*Attest:*

DOUGLAS B. COMER

*Attesting Officer*

*Acting Commissioner of Patents and Trademarks*